US005423899A

United States Patent [19]

Krall et al.

[11] Patent Number: 5,423,899

[45] Date of Patent: Jun. 13, 1995

[54] DISPERSION ALLOYED HARD METAL COMPOSITES AND METHOD FOR PRODUCING SAME

[75] Inventors: Jack Krall, Latrobe, Pa.; Anders Olsson, Fagersta, Sweden

[73] Assignee: Newcomer Products, Inc., Latrobe, Pa.

[21] Appl. No.: 93,087

[22] Filed: Jul. 16, 1993

[51] Int. Cl.[6] ..... C22C 29/12; B22F 3/12

[52] U.S. Cl. ..... 75/231; 75/240; 75/242; 419/36; 419/38

[58] Field of Search ..... 75/231, 240, 242, 246; 419/15, 18, 36, 38

[56] References Cited

U.S. PATENT DOCUMENTS

| | | | |
|---|---|---|---|
| 2,731,711 | 1/1956 | Lucas | 29/182.8 |
| 3,451,791 | 6/1969 | Meadows | 29/182.8 |
| 3,660,050 | 5/1972 | Iler et al. | 29/182.8 |
| 4,013,460 | 3/1977 | Brown et al. | 75/204 |
| 4,017,480 | 4/1977 | Baum | 428/601 |
| 4,070,184 | 1/1978 | Scheithauer, Jr. et al. | 75/203 |
| 4,101,318 | 7/1978 | Rudy | 75/240 |
| 4,394,170 | 7/1983 | Sawaoka et al. | 75/233 |
| 4,398,952 | 8/1983 | Drake | 419/18 |
| 4,525,178 | 6/1985 | Hall | 51/309 |
| 4,596,693 | 6/1986 | Ishizuka et al. | 419/16 |
| 4,604,106 | 8/1986 | Hall et al. | 51/293 |
| 4,608,318 | 8/1986 | Makrides et al. | 428/553 |
| 4,670,408 | 6/1987 | Petzow et al. | 501/87 |
| 4,719,076 | 1/1988 | Geczy et al. | 419/8 |
| 4,872,904 | 10/1989 | Dorfman | 75/0.5 BA |
| 4,956,012 | 9/1990 | Jacobs et al. | 75/236 |
| 5,045,277 | 9/1991 | Penkunas et al. | 419/15 |

FOREIGN PATENT DOCUMENTS

| | | |
|---|---|---|
| 0095668 | 12/1983 | European Pat. Off. . |
| 1525290 | 1/1981 | United Kingdom . |
| 1588208 | 4/1981 | United Kingdom . |
| 2074609A | 3/1983 | United Kingdom . |
| WO90/11855 | 10/1890 | WIPO . |

OTHER PUBLICATIONS

Article "Structure and Properties Of Dual Properties Carbide For Rock Drilling" by Aronsson, Hartzell and Akerman.

DIN 30 900 (Ed. Jul. 1982) "Terminologie der Pulvermetallurgie", p. 14 (No translation).

F. Eisenkolb "Fortschritte der Pulvermetallurgie", vol. II, Akademie-Vlg. Berlin, 1963, pp. 493–543 No translation.

*Primary Examiner*—Ngoclan Mai

*Attorney, Agent, or Firm*—Buchanan Ingersoll; Michael L. Dever

[57] ABSTRACT

A method for forming a sintered hard metal composite is provided in which unsintered nodules of a pre-blended hard metal powder of a first grade are uniformly dispersed into unsintered nodules of a pre-blended hard metal composite of a second grade. The pre-blended hard metal powders form a composite powder blend which is subsequently pressed and sintered to form the dispersion alloyed hard metal composite. A sufficient amount of pressing lubricant is provided to one of the pre-blended hard metal powders so that each of the hard metal powders shrinks at approximately the same rate relative to the application of pressure during the compacting process. The pressing lubricant is added to that hard metal powder which shrinks more during sintering. By providing uniform shrinkage of the constituent powder grades, migration of the binder from one constituent grade to the other constituent grade is minimized, thereby allowing the composite powder blend to achieve superior properties because each of the constituent grades maintains its own integrity. In addition, the uniform shrinkage of the constituent powders prevents irregular surface conditions of the "as sintered" surface.

23 Claims, 7 Drawing Sheets

DISPERSION ALLOYED HARD METAL COMPOSITES AND METHOD FOR PRODUCING SAME

FIELD OF THE INVENTION

The present invention relates to hard metal composites and more particularly to cemented carbide compositions having improved properties and a method for their formation.

DESCRIPTION OF THE PRIOR ART

Hard metals are composites consisting of metal carbides, primarily tungsten carbide, and a binder material, generally cobalt, and are commonly known as cemented carbides. The metal carbide and binder material are blended together as powders, pressed, and sintered in a protective atmosphere or vacuum. During sintering, the binder material, which may range from 1% to 25% by weight of the compact, or higher, forms a liquid phase and completely surrounds the metal carbide particles, thereby achieving full density. A "fully" dense hard metal is generally considered one in which the actual density is greater than 99.5% of the theoretical density of the composite.

The resultant cemented tungsten carbide composite exhibits very high hardness and relatively high toughness. Such composites are widely used as metal cutting tools and mining or earth drilling tools. In addition, these composites are used in metal stamping, forming and powder compacting applications.

It is well known that the two most important factors affecting the hardness and toughness properties of fully dense hard metal composites are the binder content and the particle size (grain size) of the metal carbides employed. The higher the binder content of a composite, the lower the hardness. Conversely, the lower the binder content of the composite, the lower its toughness. In addition, the hardness of the composite increases as the particle size of the metal carbide employed is decreased. To a lesser extent, the toughness of a composite decreases as the particle size of the metal carbide employed is decreased. Consequently, until recently, it had always been necessary to sacrifice either the hardness or toughness of the composite in order to improve the other property by these means.

Recently, a new hard metal composite has been formed from a mixture of two or more pre-blended, unsintered hard metal composites in which the properties of each constituent composite are different. Such a dispersion alloyed hard metal composite is discussed in U.S. Pat. No. 4,956,012. Therein, the constituent components of the hard metal composite are selected so that they have different grain sizes, different binder contents, different metal carbide or binders, or some combination of these. Primarily, the constituents are chosen on the basis of their properties and compatibility, and are chosen to utilize the superior properties of one of the constituents without detrimentally affecting the desirable properties of the other. As an example, a pre-blended composite having superior hardness may be dispersed in a second composite having superior toughness with the resultant material having a hardness which approaches that of the harder constituent yet maintains the toughness of the matrix constituent.

Although the hard metal composite disclosed in U.S. Pat. No. 4,956,012 produces a superior composite, it has been found that the binder sometimes may tend to migrate during liquid phase sintering in such a way that the physical properties of each constituent component change and become more similar to each other. When this occurs, the resulting hard metal composite performs more like a traditional single mixture instead of utilizing the superior properties of each of the constituents.

The amount of binder migration that occurs in traditional wafer or gradient composites is affected by the temperature and duration of sintering. It has been found that binder migration can be minimized by sintering at extremely low temperatures. However, composites manufactured in such a manner often do not reach full density and have deficient structures and physical properties that differ from those of the original design Consequently, there is a need for an improved method for forming a hard metal composite which minimizes the deleterious effects of binder migration.

SUMMARY OF THE INVENTION

In the present invention, it has been discovered that binder migration sometimes occurs in the dispersion alloyed hard metal composite as described in U.S. Pat. No. 4,956,012. Binder migration occurs primarily when the composite is shrinking during sintering. Equilibrium is reached when the composite reaches full density. This differs from the traditional wafer composite wherein migration of the binder continues after full density is reached until the capillary forces are in equilibrium.

In a traditional wafer composite, when sintering different grades of carbide together, the binder migrates from one material to the other when it becomes hot enough to liquefy. Small, fine grains of tungsten carbide have a much larger surface area to cover with the binder relative to coarser grain carbides. As a result, the layers of binder which bond to the fine grain carbides are very thin whereas the layers of cobalt which bind the coarser grain carbides are relatively thick provided the percentage of the binder is the same for each composition.

Capillary forces are higher when the layers of the binder material are very thin, causing the binder to be drawn or migrate from the coarser grain carbides to the fine grain carbides. During the liquid phase, the migration continues in a traditional wafer composite until the thickness of both binder layers of the composite are equal. That is to say, migration continues until the capillary forces between the two materials reaches an equilibrium.

If the wafer composite is cooled until the binder is no longer liquid, migration stops. Heating the part again causes migration to pick-up where it left off. If the sintering temperature is increased, the surface tension and viscosity of the binder decreases, allowing the binder to migrate at a faster rate until equilibrium is reached. When equilibrium is attained, the properties of the separate composites are similar, thereby minimizing the value of having a composite.

When pressed powders are sintered, a substantial amount of shrinkage takes place until the constituent composites are fully dense. Each grade of carbide shrinks at a different rate. If a wafer composite is sintered, one of the constituent layers will shrink more than the other, causing the piece to distort or warp. When the binder migrates from one layer to another, there is a volume change which also contributes to warpage.

In a composite carbide formed according to U.S. Pat. No. 4,956,012, where the constituents have the same cobalt content before sintering, the binder migrates from the material that shrinks the least to the material that shrinks the most. Although the shrinkage of the materials is not the only factor affecting binder migration, it is the major parameter to control the final cobalt content of the constituents. In general, most fine grain carbide grades shrink more than coarse grain carbide grades during sintering. In this respect, the direction of binder migration in such a composite is the same as for a wafer composite, but the mechanism or driving force is different. Only minimal migration occurs in a pellet composite formed in accordance with U.S. Pat. No. 4,956,012 when the shrinkages of the two constituents are equal regardless of their grain size.

The shrinkage of the constituent components of the alloyed hard metal composite can be modified by means of a pressing lubricant. The pressing lubricant can be used to adjust the shrinkage of each constituent material until such shrinkage is equal. When such shrinkage is equal, binder migration will be nearly eliminated.

When pressure is applied to powder metals, those metals are compacted to a "green density". When a lubricant such as stearic acid or an ethomeen compound is added to the powder metal, the resistance of the metal to compaction is reduced. As a result, when a lubricant is added the part compacts further, producing a greater "green density" wherein the percentage of additional shrinkage that occurs during final sintering is reduced. By adjusting the type and quantities of lubricants, it is possible to control the shrinkage of each composite component.

By controlling the binder migration, the physical properties of the composite are also controlled. The tough matrix maintains its optimal strength while the pellet maintains its hardness and wear resistance. As a result, the properties of each component of a pellet composite are significantly enhanced over those of a wafer composite made of the same materials.

DETAILED DESCRIPTION OF THE PREFERRED EMBODIMENTS

Figure 1:
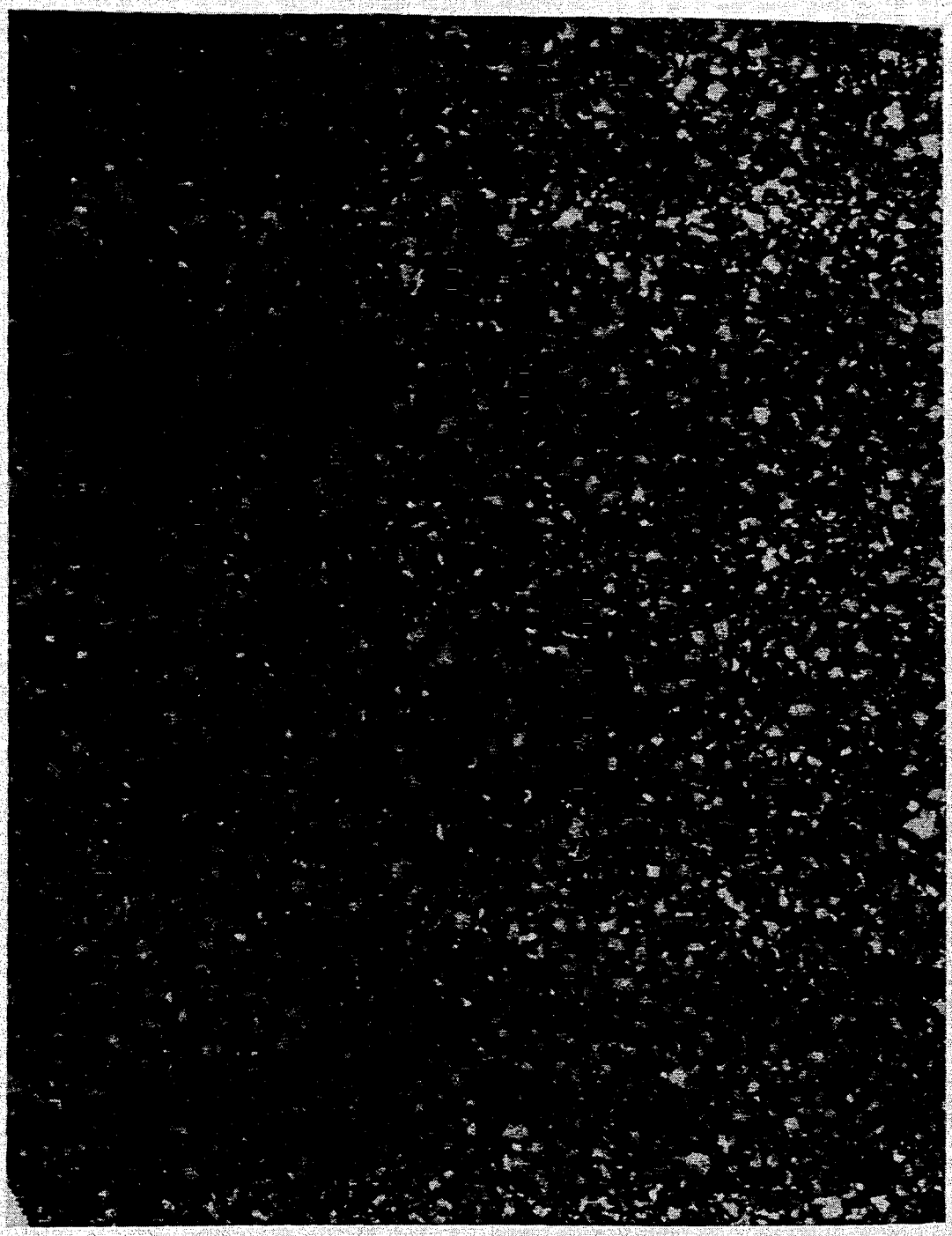
FIG. 1 is a photomicrograph showing a magnification at 1500 diameters of a submicron grained hard metal whose tungsten carbide grains average less than 1 micron.

FIG. 1 shows the microstructure of a sintered submicron grained hard metal composed of tungsten carbide and a cobalt binder. The particle size of the tungsten carbide is generally less than one micron, although a few grains are in excess of one micron. The binder content of this submicron grained hard metal is 6% by weight. This submicron grained hard metal is a grade used for high wear resistance application where little impact resistance is required. An example of such a hard metal is Newcomer Products, Inc. Grade NP32 having 6% cobalt and the balance being submicron tungsten carbide.

Figure 2:
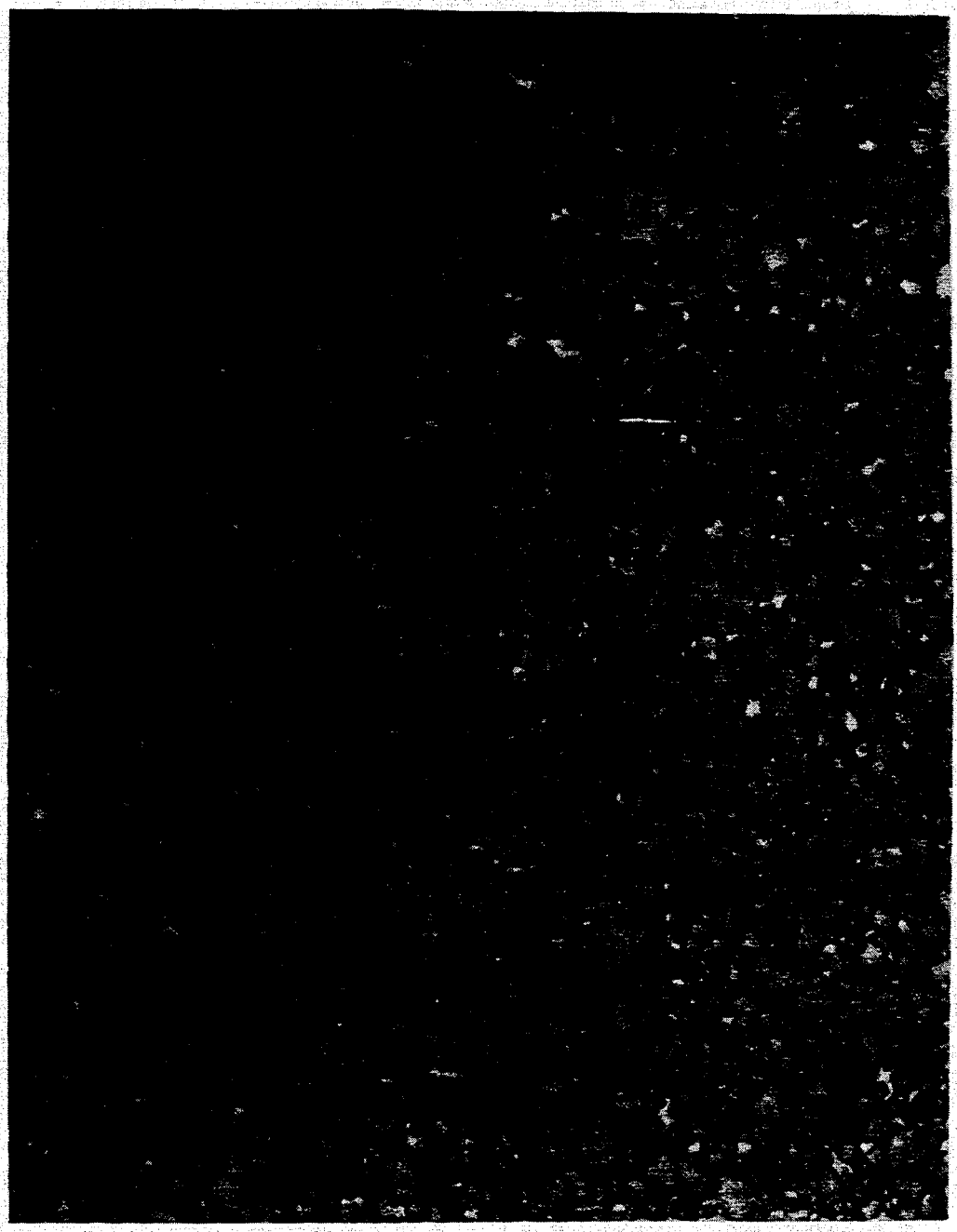
FIG. 2 is a photomicrograph showing a magnification at 1500 diameters of a medium grained hard metal whose tungsten carbide grains range from 3 to 5 microns.

FIG. 2 shows the microstructure of a sintered medium grained hard metal composed of tungsten carbide particles surrounded by a cobalt binder. The particle size of the tungsten carbide generally ranges from 3 to 5 microns. The binder content of this medium grained hard metal is 6% by weight. This medium grained hard metal is a typical grade for high impact resistance application. An example of such a hard metal is Newcomer Products, Inc. Grade N406 having 6% cobalt and the balance being 3 to 5 micron diameter tungsten carbide.

The submicron grained hard metal of FIG. 1 is a "hard" composition. The medium grained hard metal of FIG. 2 is a "tough" composition. In the present invention, the "tough" composite and the "hard" composite are combined to form a dispersion alloyed hard metal composite having the toughness of the "tough" composite and wear resistance nearly that of the "hard" composite.

The dispersion alloyed hard metal composite of the present invention is formed by dispersing unsintered nodules of the "hard" composite of FIG. 1 in unsintered nodules of the "tough" composite of FIG. 2. The constituents of the dispersion alloyed hard metal composite are dispersed prior to pressing and sintering of the constituent composites. The dispersion alloyed hard metal composite may contain up to approximately 50% by weight of the "hard" constituent and the balance as the "tough" matrix constituent.

Any pelletizing process can be used to produce the pellets or nodules of the select grade. Preferred processes include vibratory pelletizing, wet pelletizing, slugging and granulating methods, and spray drying. The "hard" and "tough" components are then precisely weighed and mixed by a very gentle dry-mixing of the pre-blended pellets to avoid breaking the pellets. Pressing and sintering of the hard metal composite is then performed by normal means. Secondary sintering processes, such as hot isostatic pressing or a low pressure sinter-hip process, may be performed to enhance the resultant properties of the hard metal composite.

Figure 3:
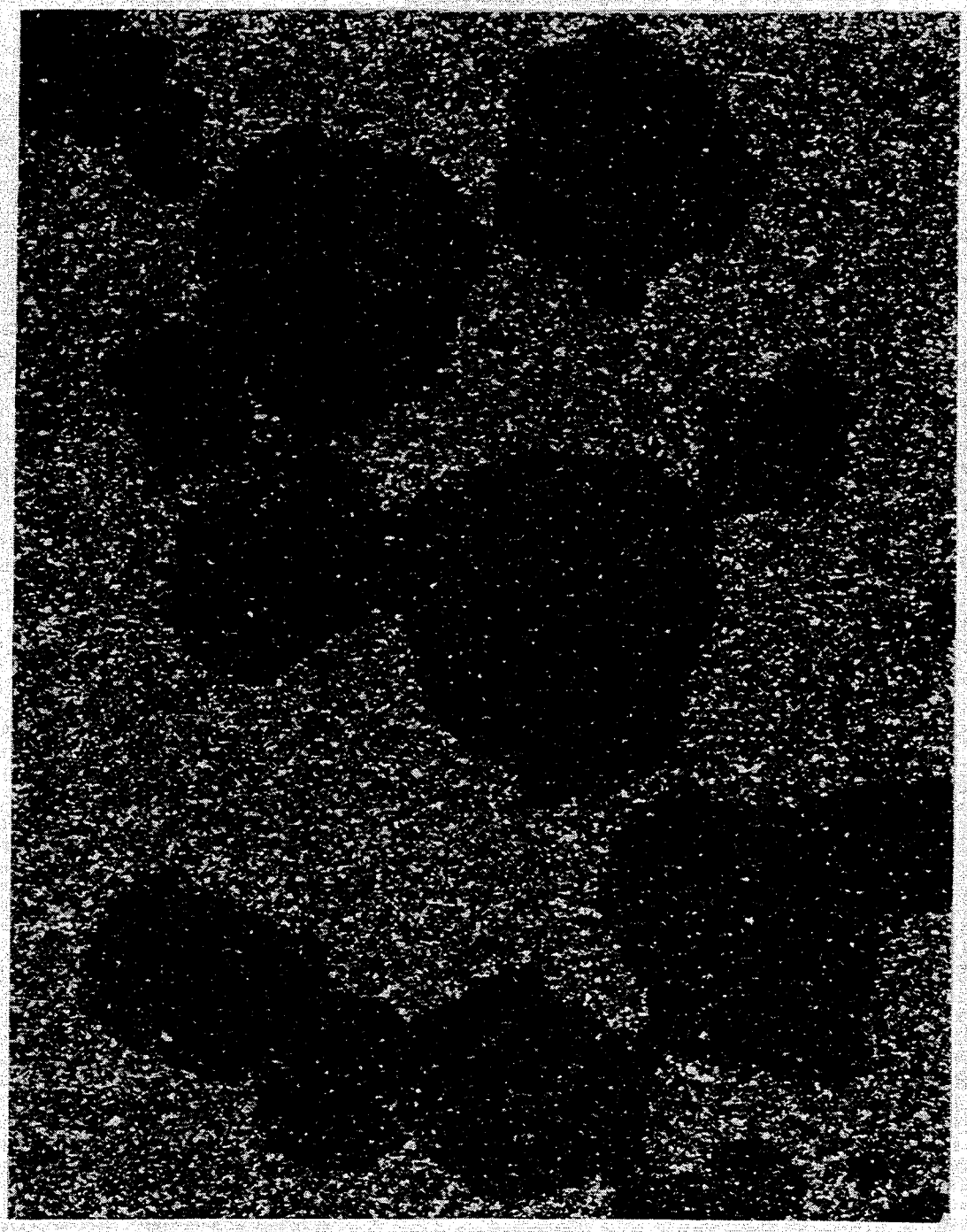
FIG. 3 is a photomicrograph showing a magnification at 150 diameters of a dispersion alloyed hard metal composite according to the present invention.
Figure 4:
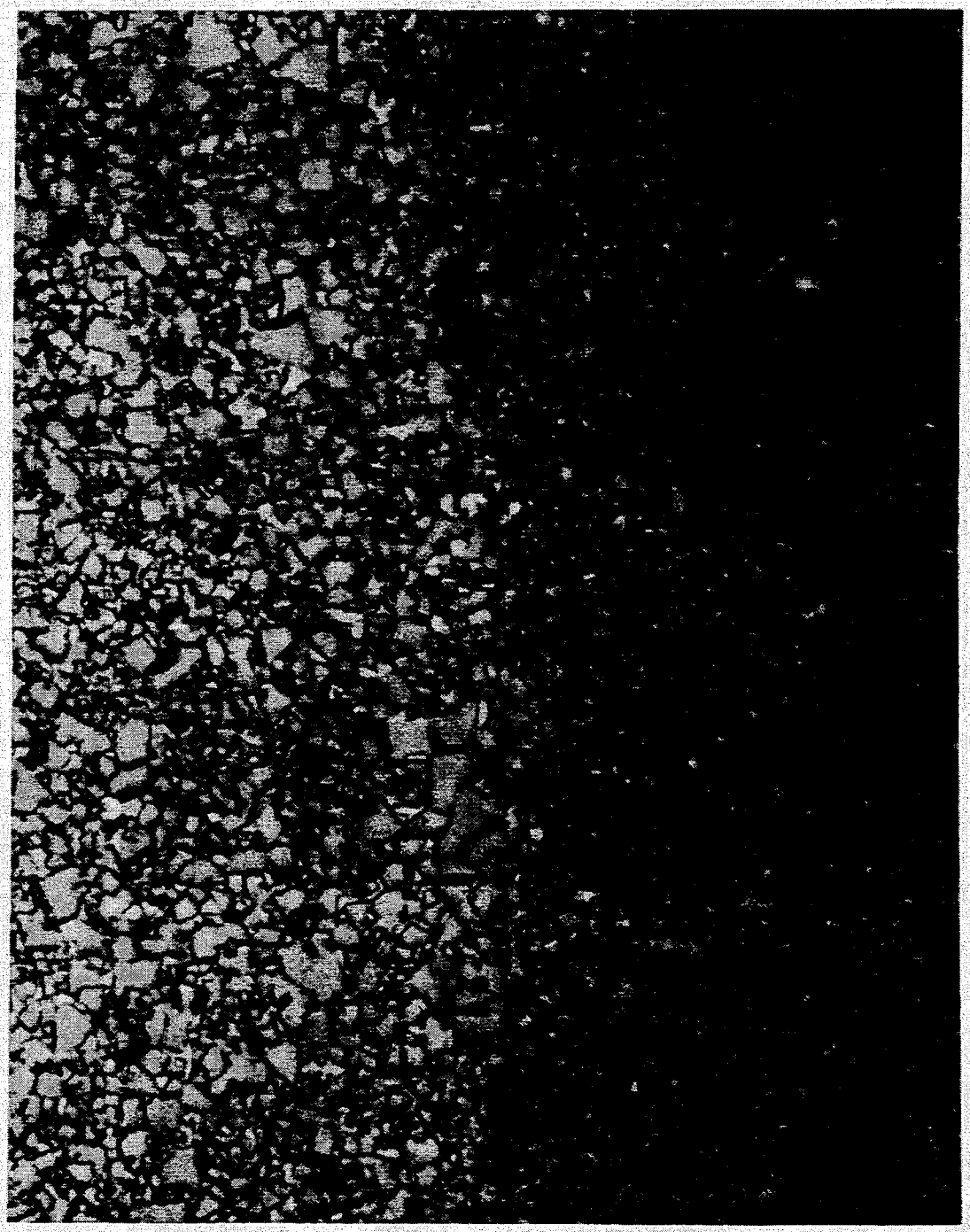
FIG. 4 is a photomicrograph showing a magnification at 1500 diameters of the dispersion alloyed hard metal composite of FIG. 3 showing the interface between the medium grained hard metal and the submicron grained hard metal constituents.

FIG. 3 shows the dispersion of the "hard" constituent (Grade NP32) and the "tough" constituent (Grade N406) at 150 magnifications in the sintered state. Nodules of the submicron grained composite are seen as islands dispersed through the lighter-colored medium grained matrix. FIG. 4 shows the dispersion alloyed hard metal composite of FIG. 3 at 1500 magnification. The sintering is complete within the individual constituents and between the differing constituent grades. This provides a fully dense composite. Full density is achieved because the pressing and sintering of the constituent composites does not occur until they are fully mixed. It has been found that the medium grained hard metal shown in FIG. 2 shrinks less than the submicron grained hard metal of FIG. 1. The submicron grained metal powder shrinks to a greater degree than the medium grained hard metal powder. Thus, with respect to the composite shown in FIG. 3, if the "hard" pellets have a greater shrinkage than the "tough" matrix, the volume reduction during sintering will be greater for the dispersed pellets. This can cause portions of the dispersed pellets to separate from the matrix resulting in voids within the composite. While sinter-hipping or secondary hipping operations can correct most of these defects, the net result is usually a composite with inferior properties or with added costs to manufacture.

An example of a dispersion alloyed hard metal composite is Newcomer Products, Inc. grade NJL35 having 65% N406 grade carbide as the "matrix grade" and 35% NP32 grade carbide as the dispersed pellets. The physical properties of NJL35, N406 and NP32 are presented in Table I below:

TABLE I

| | Physical Properties | | |
|---|---|---|---|
| | NJL35 | N406 | NP32 |
| Density | 15.00 | 15.00 | 14.95 |
| Hardness | 91.5 | 90.7 | 92.7 |
| TRS | 425,000 | 425,000 | 380,000 |
| HC | 225 | 160 | 280 |
| Porosity | A02 | A02 | A02 |

The component that shrinks the most will appear as an indent or recessed pit on the surface of the as-sintered composite. This rough surface is detrimental to the performance of cutting tools as well as wear parts. Particularly, this rough surface is detrimental when impacts and internal stresses are involved. Secondary grinding operations can produce smooth surfaces, but this extra operation is not always practical or cost effective. If the constituent hard metal powders are designed to shrink at the same rate, the deleterious effects of different shrinking rates are eliminated as are the problems of binder migration. In order to provide equal shrinkage, a lubricant is added to the "hard" powder to cause it to shrink less than the original powder when equal compacting pressures are applied. This lubricant, which preferably is a stearate compound such as stearic acid, is added in a heptane solvent to the binder prior to pelletizing the constituent hard metal powder. By adding the lubricant, the shrinkage of the constituent parts is made uniform, thereby preventing the volume reduction effects during sintering and eliminating binder migration. This stearate lubricant can be added to the composite in place of or in addition to the paraffin normally added to the powders for pelletizing and compacting.

Figure 5:
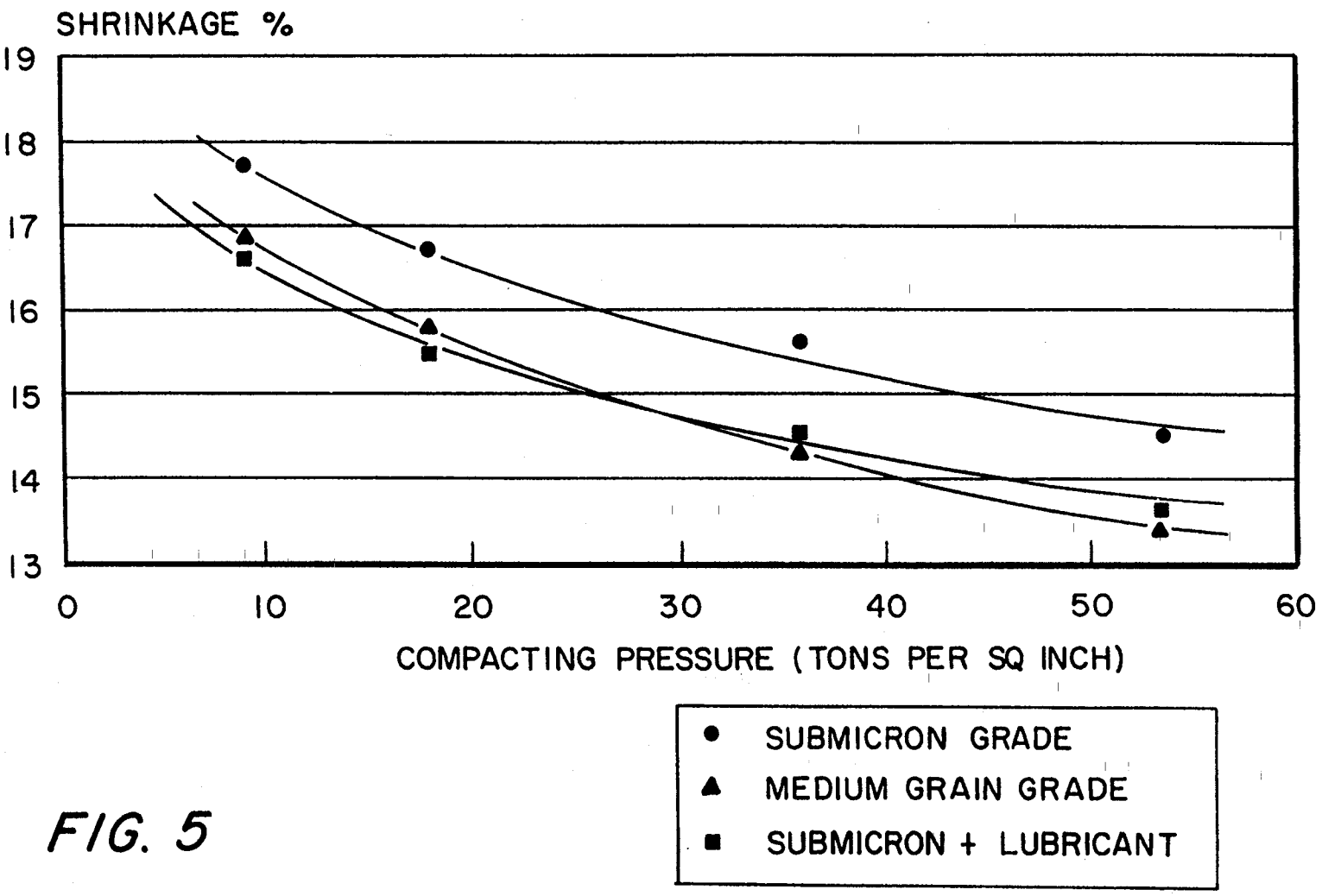
FIG. 5 is a graph showing the shrinkage rates of the hard metal powder composite of FIG. 1, hard metal powder composite of FIG. 2, and a hard metal powder composite of FIG. 3 modified in accordance with the present invention.

FIG. 5 shows a shrinkage comparison of a "hard" tungsten carbide grade designated NP32 and a "tough" tungsten carbide grade designated N406. When stearic acid is added to the "hard" NP32 grade, its shrinkage rate is adjusted to approximate the shrinkage of the "tough" N406 composite. As to the example in FIG. 5, the dispersion alloyed hard metal composite formed from N406 and NP32 plus stearic acid constituents should be pressed or compacted at approximately 25–30 tons per square inch pressure for the least amount of cobalt migration to occur during sintering. This compacting pressure is found by the intersection of the shrinkage curves for the N406 constituent and the NP32 with added stearic acid constituent, although minimal binder migration would occur at any pressure because the shrinkage is similar over the entire curve compared to the submicron grade without special lubricants added.

It has been found that temperature has little or no effect on the amount of binder migration that occurs in the dispersion alloyed hard metal composite formed in accordance with this invention. Likewise, sintering time has little or no effect on the amount of binder migration. Once full density of the resulting composite is reached, binder migration ceases. Because the shrinkages of the "tough" and "hard" constituents are equalized, the volume reduction during sintering of the composite is equal in all directions. This results in a composite that maintains its shape throughout sintering and maintains a smooth "as sintered" surface condition.

In order to show that the mechanism for binder migration differs between the dispersed composite of the present invention and traditional composites, we made a traditional wafer composite having the same materials as the dispersed composite of FIG. 3. In order to compare the results with the dispersed composite having 35% by weight pellets, the wafer composite was formulated such that one of the wafer layers was 35% by weight of the wafer composite.

In conformance with traditional technology, the wafer composite exhibited cobalt migration that continued each time the composite was heated or reheated until the capillary forces reached equilibrium. Although the dispersed pellet without added lubricant exhibited cobalt migration, the amount of such migration was never as great as in the wafer composite. Moreover, the dispersed composite did not exhibit additional cobalt migration upon reheating. Furthermore, adding lubricants to the dispersed composite to equalize shrinkage resulted in nearly zero migration. These differences in results between the wafer composite and the dispersed composite show that different mechanisms are involved in the binder migration.

Figure 6:
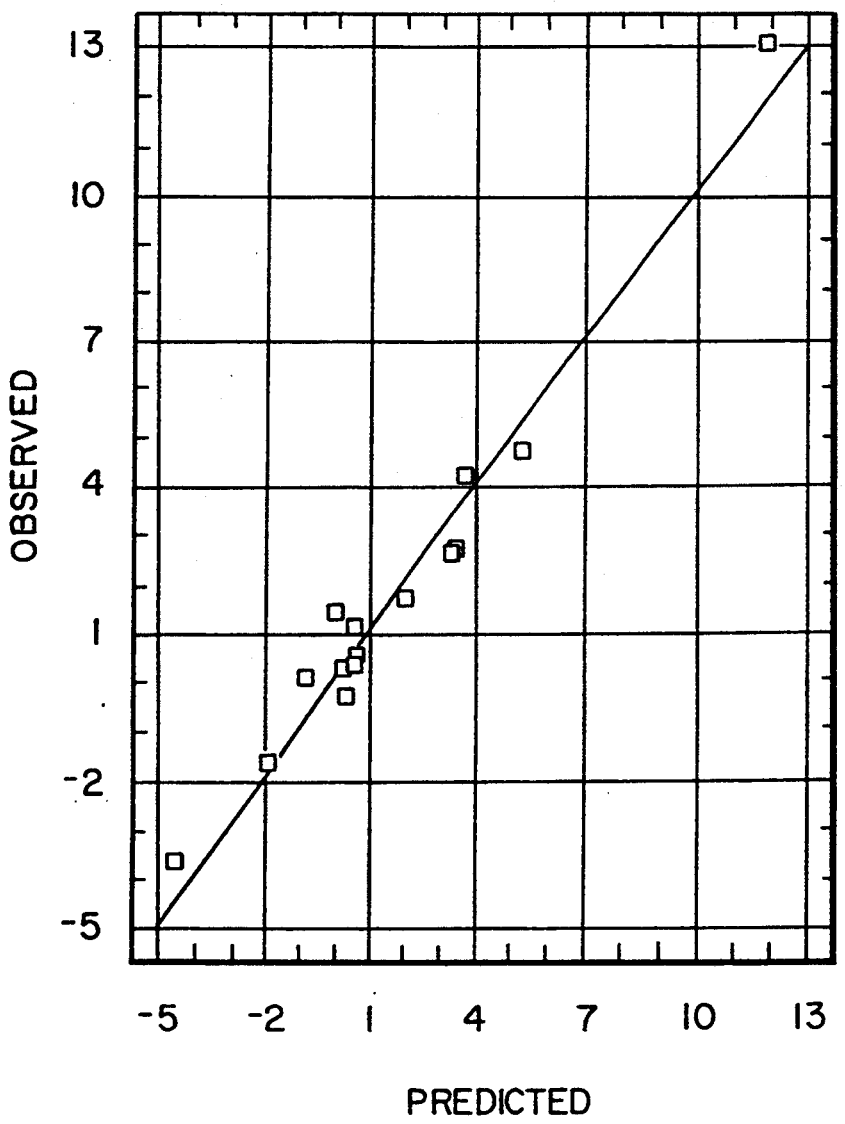
FIG. 6 is a graph comparing the predicted cobalt migration to the observed cobalt migration for a dispersion alloyed hard metal composite formed in accordance with the present invention.

We have developed an equation to predict the amount of cobalt migration based on the shrinkage difference of the components and the initial cobalt content of the constituents. That equation is represented below where the amount of cobalt migration is expressed as the change of cobalt content of the hard constituent:

$$\text{Cobalt Migration} = Co(P) - Co(P)_o \quad (1)$$

$$= A^*(1-P)^*(Co(P)_o - Co(M)_o) + B^*((\text{SHRINKD}) \quad (2)$$

where:

Co(P)=cobalt in pellets in sintered composite $Co(M)_o$=initial cobalt in matrix $Co(P)_o$=initial cobalt in pellets P=percent of pellets by weight SHRINKD=shrinkage difference between pellets and matrix A and B=constants derived from FIG. 6

Equation (2) is based on two parts. The first term is derived from the assumption that the constituents want to equalize the cobalt content and the second term is the influence of a difference in shrinkage.

Fifteen different mixtures have been made and analyzed regarding cobalt migration. Data derived from the analysis is set forth in FIG. 6. Using statistical methods, the constants "A" and "B" have been determined from the accumulated data resulting in FIG. 6. The values of "A" and "B" used to fit the data in FIG. 6 are −1.096287 and 0.46081, respectively. These values of "A" and "B" are each statistically significant to more than 95%.

From Equation (2), it can be seen that when $Co(P)_o$ equals $Co(M)_o$, the only significant factor in binder migration is the shrinkage difference. Consequently, when the shrinkage difference is reduced to 0, binder migration does not occur to any significant amount. When $Co(P)_o$ does not equal $Co(M)_o$, binder migration can still be reduced to nearly zero by altering the shrinkage difference enough to counteract the natural tendency for the cobalt to migrate.

Equation (2) above can also be used to calculate the desired compositions of the starting components and the shrinkage difference needed to create a sintered composite that has had a controlled intentional amount of binder migration in order to formulate desired compositions and properties.

It has been found that the above equation can be used for composites having more than two components and for composites having different binders such as cobalt, nickel, iron or combinations of binders. The equation also can be used when different mutually soluble binders are used for each component.

Figure 7:
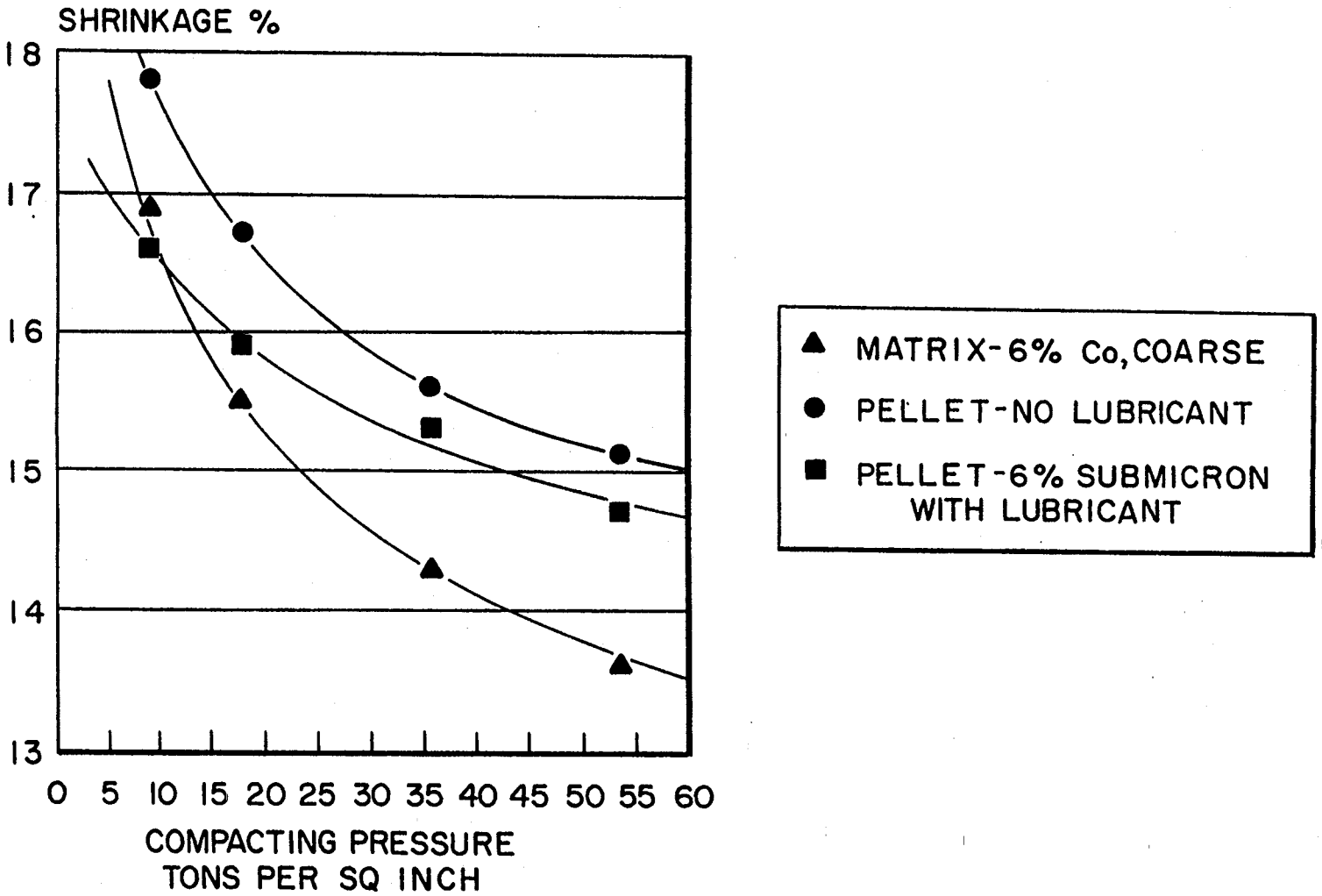
FIG. 7 is a graph-showing the shrinkage rates of a coarse grained hard metal powder matrix, a submicron grained hard metal powder pellet having no lubricant added, and a submicron grained hard metal powder pellet having added lubricant.

FIG. 7 shows the relationship of compacting tooling requirements and design to the desired shrinkage adjustment. In the example shown in FIG. 7, both the matrix and the pellet have 6% cobalt content. According to the equation, the shrinkage difference must be zero in order to produce a composite having no cobalt migration.

The shrinkage curve produced for the pellet having no added lubricant does not intersect the shrinkage curve produced for the matrix. Consequently, there is no point at which there is a zero shrinkage difference between the pellet and the matrix.

In contrast, the shrinkage curve for the pellet having added lubricant does intersect the matrix shrinkage curve at 16.5% shrinkage and a compacting pressure of 10 tons per square inch. Accordingly, compacting tooling designed using these parameters and using these components will produce a sintered composite having nearly zero binder migration.

In the above description, tungsten carbide was used as a representative hard metal and cobalt was used as a representative binder for the hard metal composite. It should be understood that the present invention applies equally as well to other hard metals such as titanium carbide, tantalum carbide, niobium carbide, and combinations of these carbides and combinations of these carbides with tungsten carbide. It should also be understood that the present invention applies equally as well to other binders such as iron, nickel and other materials that form a liquid state during sintering as well as mixtures thereof.

In the foregoing specification certain preferred practices and embodiments of this invention have been set out, however, it will be understood that the invention may be otherwise embodied within the scope of the following claims.

We claim:

1. A method for forming a sintered hard metal composite comprising the steps of:
(a) uniformly dispersing unsintered nodules of a pre-blended hard metal powder of a first grade into unsintered nodules of a pre-blended hard metal powder of a second different grade to form a composite powder blend;
(b) processing said pre-blended hard metal powder of a first grade and said pre-blended hard metal powder of a second grade such that each said hard metal powder shrinks by approximately the same rate when compacted and sintered;
(c) pressing said composite powder blend; and
(d) sintering said composite powder blend.

2. A method for forming a sintered hard metal composite comprising the steps of:
(a) uniformly dispersing unsintered nodules of a pre-blended hard metal powder of a first grade into unsintered nodules of a pre-blended hard metal powder of a second different grade to form a composite powder blend;
(b) determining the shrinkage of said pre-blended hard metal powder of a first grade and said pre-blended hard metal powder of a second grade relative to the application of pressure;
(c) providing a sufficient amount of a pressing lubricant to the hard metal powder which shrinks more such that each said hard metal powder shrinks at approximately the same rate relative to the application of compacting pressure;
(d) pressing said composite powder blend; and
(e) sintering said composite powder blend.

3. The method of claim 2 wherein said each of said pre-blended hard metal powder of a first grade and said pre-blended hard metal powder of a second grade comprise tungsten carbide and a binder, said pressing lubricant providing sufficient shrinkage adjustment of said at least one of said pre-blended hard metal powder of a first grade and said pre-blended hard metal powder of a second grade to prevent migration of said binder from which of said pre-blended hard metal powder of a first grade and said pre-blended hard metal powder of a second grade that shrinks less relative to the application of pressure.

4. The method of claim 3 wherein said binder is cobalt.

5. The method of claim 3 wherein said binder is nickel.

6. The method of claim 3 wherein said binder is iron.

7. A method for forming a sintered hard metal composite comprising the steps of:
(a) uniformly dispersing unsintered nodules of a pre-blended hard metal powder of a first grade into unsintered nodules of a pre-blended hard metal powder of a second different grade to form a composite powder blend
(b) providing a sufficient amount of a stearate compound pressing lubricant to at least one of said pre-blended hard metal powder of a first grade and said pre-blended hard metal powder of a second grade such that each said hard metal powder shrinks at approximately the same rate relative to the application of compacting pressure;
(c) pressing said composite powder blend; and
(d) sintering said composite powder blend.

8. The method of claim 7 wherein said pressing lubricant is stearic acid.

9. A sintered hard metal composite comprising unsintered nodules of a pre-blended hard metal powder of a first grade uniformly dispersed among unsintered nodules of a pre-blended hard metal powder of second grade, said pre-blended hard metal powder of a first grade and said pre-blended hard metal powder of a second grade having distinctively different properties from each other, wherein the integrity of the constituent grades is maintained after sintering, and the resulting composite exhibits hardness and toughness properties of the hard metal powder of the first grade and the hard metal powder of the second grade, wherein at least one of said pre-blended hard metal powder of a first grade and said pre-blended hard metal powder of a second grade is processed such that each said hard metal powder shrinks by approximately the same rate when compacted and sintered.

10. A sintered hard metal composite comprising unsintered nodules of a pre-blended hard metal powder of a first grade uniformly dispersed among unsintered nodules of a pre-blended hard metal powder of second grade, said pre-blended hard metal powder of a first grade and said pre-blended hard metal powder of a second grade having distinctively different properties from each other, wherein the integrity of the constituent grades is maintained after sintering, and the resulting composite exhibits hardness and toughness properties of the hard metal powder of the first grade and the hard metal powder of the second grade, wherein a stearate compound pressing lubricant is provided in at least one of said pre-blended hard metal powder of a first grade and said pre-blended hard metal powder of a second grade.

11. The composite of claim 10 wherein said pressing lubricant is stearic acid.

12. A sintered hard metal composite comprising unsintered nodules of a pre-blended hard metal powder of a first grade uniformly dispersed among unsintered nodules of a pre-blended hard metal powder of second grade, said pre-blended hard metal powder of a first grade and said pre-blended hard metal powder of a second grade having distinctively different properties from each other, wherein the integrity of the constituent grades is maintained after sintering, and the resulting composite exhibits hardness and toughness properties of the hard metal powder of the first grade and the hard metal powder of the second grade, wherein a pressing lubricant is provided in at least one of said pre-blended hard metal powder of a first grade and said pre-blended hard metal powder of a second grade, wherein said each of said hard metal powder of a first grade and said hard metal powder of a second grade comprise tungsten carbide and a binder, said pressing lubricant providing sufficient shrinkage adjustment of said at least one of said pre-blended hard metal powder of a first grade and said pre-blended hard metal powder of a second grade to prevent migration of said binder from which of said pre-blended hard metal powder of a first grade and said pre-blended hard metal powder of a second grade that shrinks less relative to the application of pressure.

13. The composite of claim 12 wherein said binder is cobalt.

14. A sintered hard metal composite comprising unsintered nodules of a pre-blended hard metal powder of a first grade having a binder provided therein uniformly dispersed among unsintered nodules of a pre-blended hard metal powder of a second different grade having a binder provided therein, wherein a sufficient amount of pressing lubricant is provided in at least one of said pre-blended hard metal powder of a first grade and said pre-blended hard metal powder of a second grade to control the binder migration between said pre-blended hard metal powder of a first grade and said pre-blended hard metal powder of a second grade resulting from the shrinkage difference between said pre-blended hard metal powder of a first grade and said pre-blended hard metal powder of a second grade during sintering.

15. The hard metal composite of claim 14 wherein sufficient lubricant is added to equalize the shrinkage difference between said pre-blended hard metal powder of a first grade and said pre-blended hard metal powder of a second grade.

16. A method for forming a sintered hard metal composite having predetermined composition and properties comprising the steps of:

(a) uniformly dispersing unsintered nodules of a pre-blended hard metal powder of a first grade having a binder provided therein into unsintered nodules of a pre-blended hard metal powder of a second different grade having a binder provided therein to form a composite powder blend;

(b) providing a sufficient amount of pressing lubricant to at least one of said pre-blended hard metal powder of a first grade and said pre-blended hard metal powder of a second grade to control the binder migration between said hard metal powders resulting from the shrinkage difference between said hard metal powders during sintering;

(c) pressing said composite powder blend; and (d) sintering said composite powder blend.

17. A method for forming a sintered hard metal composite having predetermined composition and properties comprising the steps of:

(a) uniformly dispersing unsintered nodules of a pre-blended hard metal powder of a submicron grain size grade having a binder provided therein into unsintered nodules of a pre-blended hard metal powder of a coarser grain size grade having a binder provided therein to form a composite powder blend;

(b) providing a sufficient amount of pressing lubricant to at least one of said pre-blended hard metal powder of a submicron grain size grade and said pre-blended hard metal powder of a coarser grain size grade to control the binder migration between said hard metal powders resulting from the shrinkage difference between said hard metal powders during sintering;

(c) pressing said composite powder blend; and (d) sintering said composite powder blend, wherein binder migration is governed by the equation:

$$A*(1-P)*(C(P)_o-C(M)_o)+B*(SHRINKD)$$

wherein:

$C(P)_o$=weight percent of binder content in said pre-blended hard metal powder of a submicron grain size grade in initial powder;

$C(M)_o$=weight percent binder content in said pre-blended hard metal powder of a coarser grain size grade in initial powder P=percent of said pre-blended hard metal powder of a submicron grain size grade by weight;

SHRINKD=shrinkage difference between said pre-blended hard metal powder of a submicron grain size grade and said pre -blended hard metal powder of a coarser grain size grade; and A and B=constants, the value of which depends on the binder material.

18. The method of claim 17 wherein said binder is cobalt and constant A has the value −1.096 and constant B has the value 0.461.

19. The method of claim 16 wherein more than two hard metal constituents are used in said pre-blended hard metal powders.

20. A method for forming a sintered hard metal composite having predetermined composition and properties comprising the steps of:

(a) uniformly dispersing unsintered nodules of a pre-blended hard metal powder of a submicron grain size grade having a binder provided therein into unsintered nodules of a pre-blended hard metal powder of a coarser grain size grade having a binder provided therein to form a composite powder blend;

b) providing a sufficient amount of pressing lubricant to at least one of said pre-blended hard metal powder of a submicron grain size grade and said pre-blended hard metal powder of a coarser grain size grade to control the binder migration between said hard metal powders resulting from the shrinkage difference between said hard metal powders during sintering;

c) pressing said composite powder blend; and (d) sintering said composite powder blend, wherein more than one binder is used.

21. The method of claim 20 wherein one of the binders used is cobalt.

22. The method of claim 20 wherein one of the binders is nickel.

23. The method of claim 20 wherein one of the binders is iron.

* * * * *